US006620079B2

(12) United States Patent
Kuo

(10) Patent No.: US 6,620,079 B2
(45) **Date of Patent: *Sep. 16, 2003**

(54) EXERCISER HAVING ADJUSTABLE MECHANISM

(76) Inventor: Hai Pin Kuo, No. 158, Sec. 1, Er Jen Road, Jen Teh Hsiang, Taina Hsien (TW), 717

( * ) Notice: Subject to any disclaimer, the term of this patent is extended or adjusted under 35 U.S.C. 154(b) by 91 days.

This patent is subject to a terminal disclaimer.

(21) Appl. No.: 09/739,312

(22) Filed: Dec. 19, 2000

(65) Prior Publication Data

US 2002/0077220 A1 Jun. 20, 2002

(51) Int. Cl.[7] ..... A63B 22/00; A63B 22/12
(52) U.S. Cl. ..... 482/51; 482/52
(58) Field of Search ..... 482/51–53, 57, 482/70, 79, 80

(56) References Cited

U.S. PATENT DOCUMENTS 5,383,829 A 1/1995 Miller ..... 482/57
5,779,599 A 7/1998 Chen ..... 482/57
6,053,847 A * 4/2000 Stearns et al. ..... 482/51
6,080,086 A * 6/2000 Maresh et al. ..... 482/57
6,217,485 B1 * 4/2001 Maresh ..... 482/52
6,277,054 B1 * 8/2001 Kuo ..... 482/51
6,450,925 B1 * 9/2002 Kuo ..... 482/52
6,454,682 B1 * 9/2002 Kuo ..... 482/52

* cited by examiner

*Primary Examiner*—Stephen R. Crow
(74) *Attorney, Agent, or Firm*—Charles E. Baxley

(57) ABSTRACT

An exerciser includes a pair of foot support movably supported on a base, a pair of bars pivotally secured to the base and each having an upper handle, and a pair of links and tracks movably coupled between the base and the bars. The bars each includes a slidable slide coupled to the foot supports. A motor is coupled to the slides for moving the slides along the bars to adjust the foot supports relative to the bars and to adjust the moving stride of the exerciser. A switch is coupled to the motor for actuating the motor while the bars are swung by the users.

8 Claims, 5 Drawing Sheets

EXERCISER HAVING ADJUSTABLE MECHANISM

The present invention is related to U.S. patent application Ser. No. 09/617,772, filed Jul. 17, 2000, now U.S. Pat. No. 6,277,054.

BACKGROUND OF THE INVENTION

1. Field of the Invention

The present invention relates to an exerciser, and more particularly to a stepping exerciser having an adjustable mechanism for adjusting the moving stroke or the moving path or the stride of the exerciser.

2. Description of the Prior Art

U.S. Pat. No. 5,383,829 to Miller discloses a typical exerciser having a pair of foot supports movable along an elliptical moving path or an elliptical stride which may not be adjusted. U.S. Pat. No. 5,779,599 to Chen discloses another typical exerciser having a pair of foot supports movable along an elliptical moving path or an elliptical stride. The elliptical moving path or the elliptical stride of the exerciser may be adjusted by threading and unthreading the fasteners which may not be quickly operated or may not be quickly threaded and unthreaded relative to the elements that are required to be adjusted. In addition, the exercisers should be stopped before the moving stroke or the moving path or the stride of the exercisers may be adjusted.

The present invention has arisen to mitigate and/or obviate the afore-described disadvantages of the conventional exercisers.

SUMMARY OF THE INVENTION

The primary objective of the present invention is to provide a stepping exerciser including an adjustable mechanism for easily and quickly adjusting the moving stroke or the moving path or the stride of the exerciser without stopping the exercisers or while the exerciser is still operated.

In accordance with one aspect of the invention, there is provided an exerciser comprising a base including a front portion, a pair of bars pivotally secured to the front portion of the base and each including an upper portion for being grasped by a user, a pair of levers movably supported on the base and each including a foot support provided thereon, means for coupling the bars to the levers and to move the levers and the foot supports in a reciprocating action, means for adjusting the levers relative to the bars in order to adjust the foot supports relative to the bars, and a switch provided on the upper portion of a first of the bars and coupled to the adjusting means in order to actuate the adjusting means without stopping the exerciser. The hands of the users that hold the upper portions of the bars may depress or actuate the switch in order to adjust the levers relative to the bars and so as to adjust the moving stride of the exerciser while the bars are swung or operated by the users.

The base includes a post extended from the front portion of the base and having an upper portion, the base includes a rear portion having a pair of cranks rotatably secured thereto with a pivot shaft, the cranks each includes a free end, the bars are pivotally secured to the upper portion of the post and each includes a bottom portion, the coupling means includes a pair of tracks having a first end rotatably secured to the free ends of the cranks respectively and having a second end portion movably supported on the bottom portion of the bars, and includes a pair of links each having a first end rotatably secured to the free ends of the cranks respectively and each having a second end slidably secured to the bottom portions of the bars respectively, the levers each includes a first end pivotally secured to the bars respectively with a pivot pin, and each includes a second end slidably engaged on the tracks respectively.

The bars each includes a slide slidably received therein, the coupling means is provided for coupling the slides of the bars to the levers respectively. The adjusting means is provided for adjusting the slides relative to the bars respectively to adjust a stride of the foot supports.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
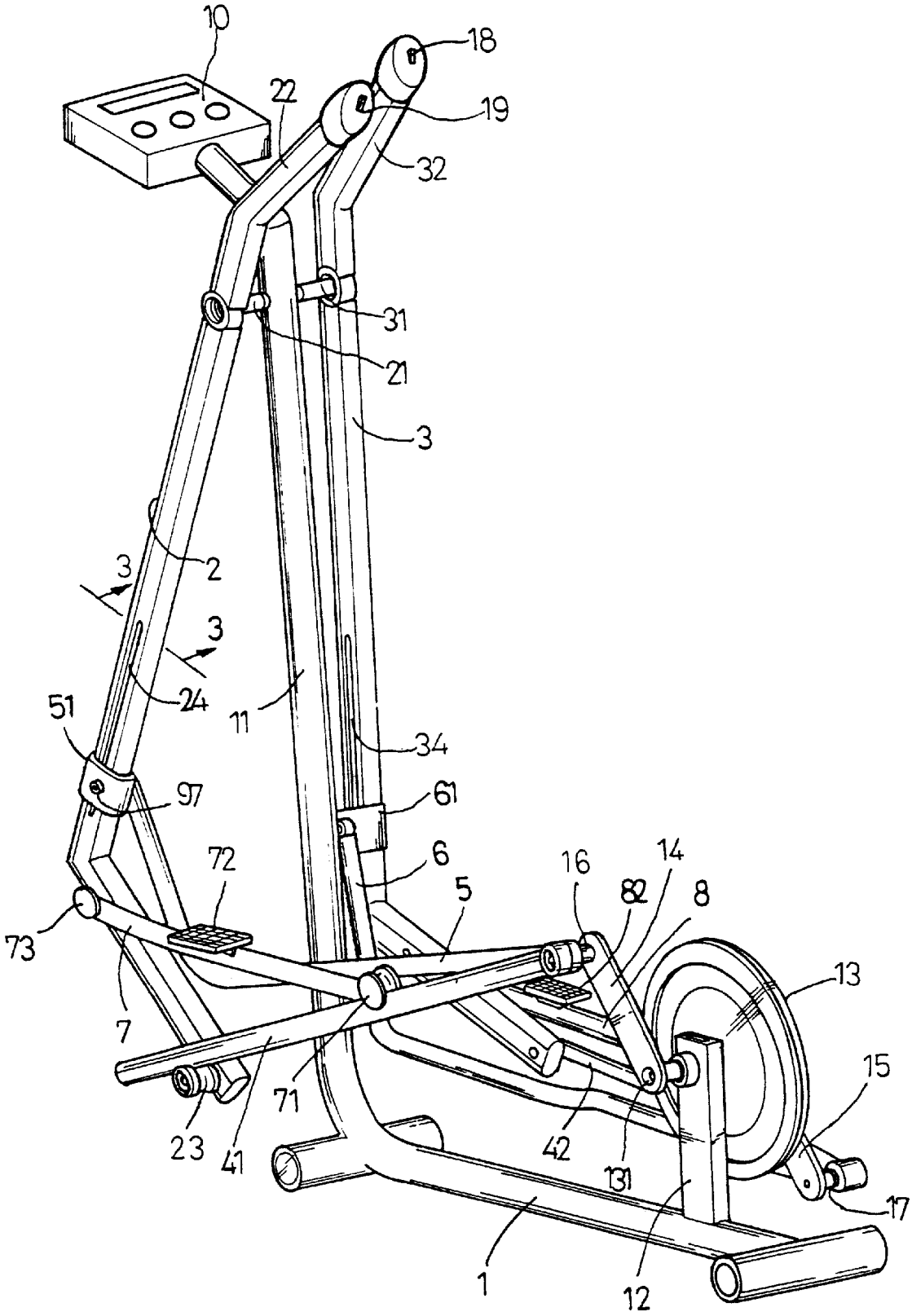
FIG. 1 is a perspective view of an exerciser in accordance with the present invention.
Figure 2:
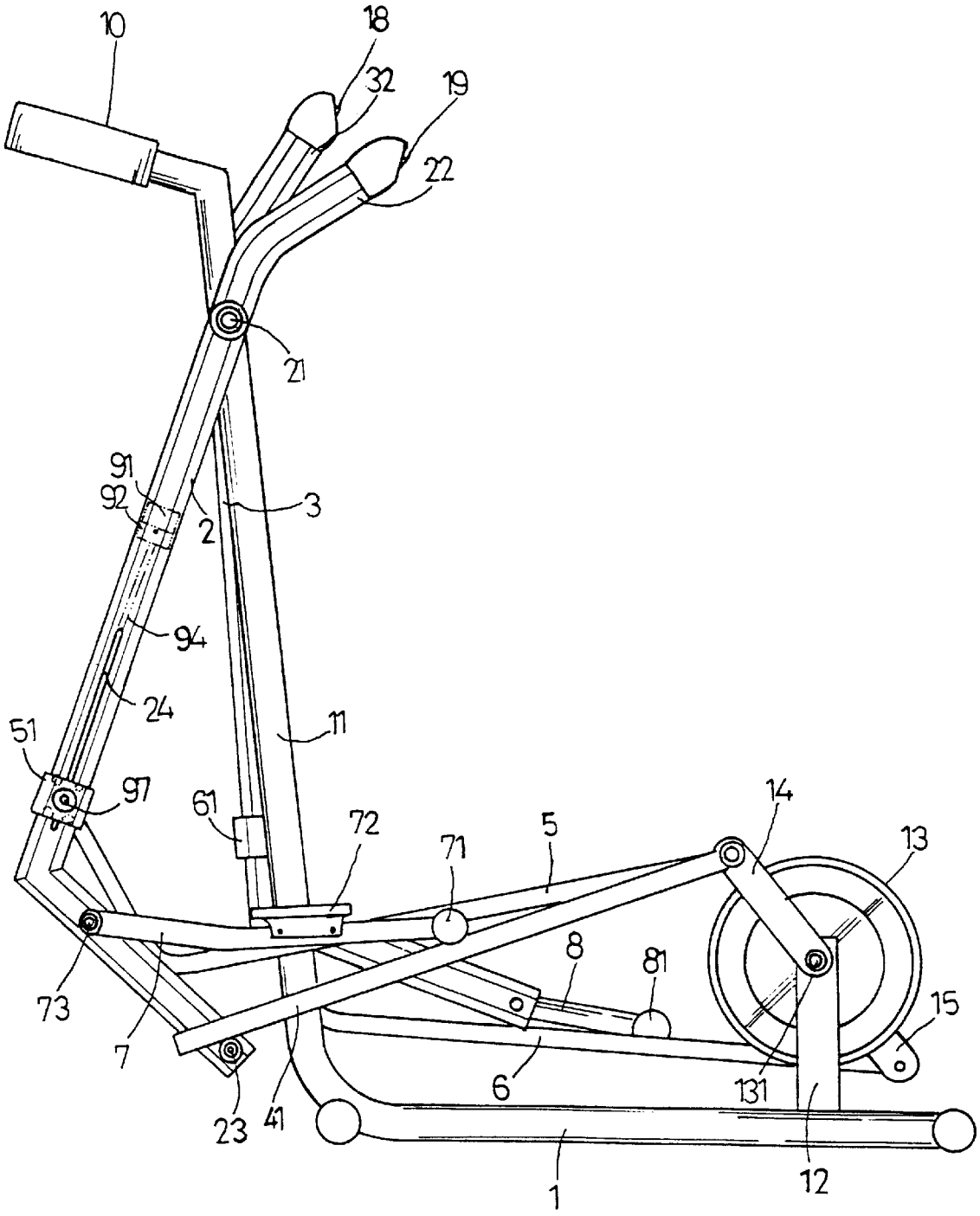
FIG. 2 is a side view of the exerciser.

Referring to the drawings, and initially to FIGS. 1 and 2, an exerciser in accordance with the present invention comprises a base 1 including a post 11 extended upward from or provided on the front portion thereof and including a stay 12 extended upward from or provided on the rear portion thereof. A control box 10 or the like is disposed on top of the post 11 for controlling the operation of the exerciser, for example. A wheel 13 and a pair of cranks 14, 15 are rotatably secured or supported on the stay 12 with a pivot shaft 131 and rotatable about the pivot shaft 131. The cranks 14, 15 are extended away from each other as that for the typical cycling devices, and each includes a free end having an axle 16, 17 attached thereto or provided thereon. The wheel 13 is used for providing a resistive force against the operation of the exerciser.

A pair of bars 2, 3 have a middle or upper portion rotatably or pivotally secured to the upper portion of the post 11 with one or more rods 21, 31, and each includes a handle 22, 32 provided on top thereof, and each includes a chamber 20 (FIG. 3) formed in the inner portion thereof, and each includes one or more slots 24, 34 formed in the middle or lower portion thereof and located or provided below the rods 21, 31, and each includes a bottom end having a pulley 23 attached thereto or provided thereon. A pair of tracks 41, 42 have a middle portion slidably or movably supported on the respective pulleys 23, and each includes one end pivotally or rotatably secured to the free ends of the cranks 14, 15 at the axles 16, 17 respectively. A pair of levers 7, 8 each has a front end pivotally or rotatably secured to the lower portions of the bars 2, 3 with a pivot pin 73, and each has a pulley 71, 81 attached to or provided on the rear portion thereof and rotatably or slidably or movably engaged on the respective tracks 41, 42, and each has a foot support 72, 82 provided on the middle portion thereof.

Figure 3:
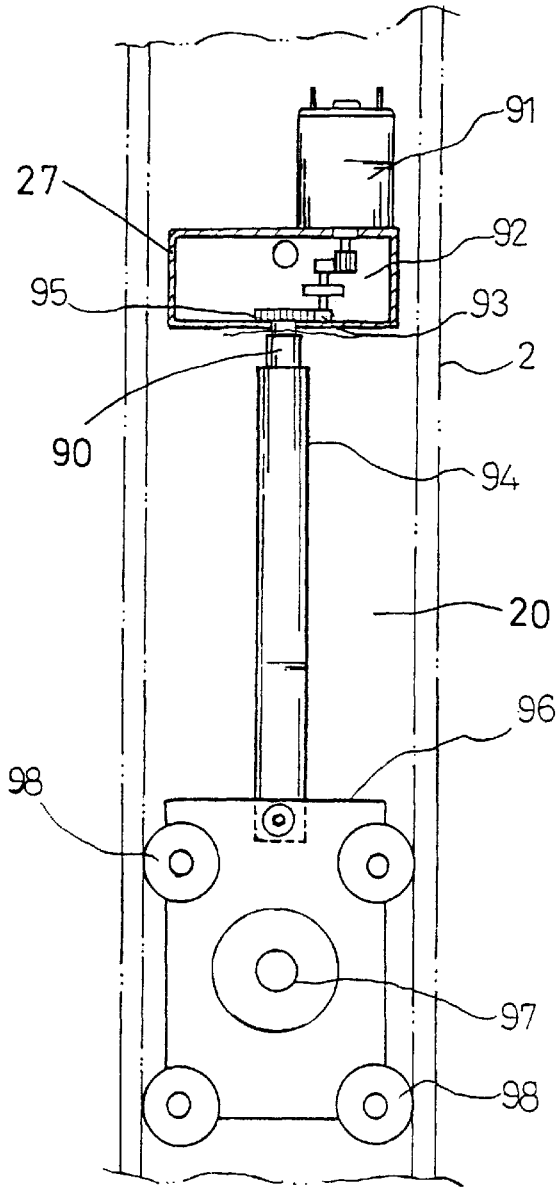
FIG. 3 is a partial cross sectional view taken along lines 3—3 of FIG. 1.
Figure 4:
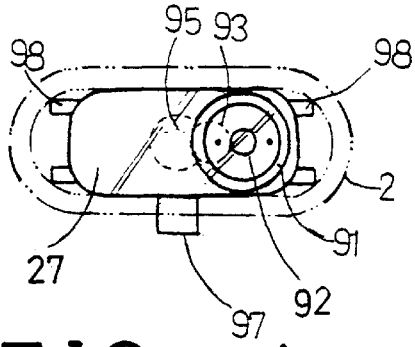
FIG. 4 is an end view of the elements as shown in FIG. 3.

As shown in FIGS. 2–4, the bars 2, 3 each includes a casing 27 secured therein. A bolt 90 is rotatably secured to each of the casings 27 and includes a gear 95 rotatably received in the casing 27. A motor 91 is secured in each of the bars 2, 3 and/or secured to the respective casings 27 and includes a pinion 92 extended therefrom or secured to the spindle thereof and preferably engaged in the casing 27. A reduction gearing device 93 is provided in the casing 27 and couples the pinion 92 of the motor 90 to the gear 95 of the bolt 90, thus the bolt 90 may be rotated by the motor 91 via the pinion 92 and the reduction gearing device 93 and the gear 95. A slide 96 is slidably received in each of the bars 2, 3 with rollers 98. A tube 94 is threaded with the bolt 90 and has one end pivotally secured to the slide 96, such that the slide 96 may be moved or adjusted along the respective bars 2, 3 by the motor 91 via the threading engagement between the bolt 90 and the tube 94. The slide 96 includes a pole 97 extended outward therefrom and slidably received in the respective slots 24, 34 of the bars 2, 3.

A pair of sleeves 51, 61 are slidably engaged on the respective bars 2, 3 and secured to the respective slides 96 with the poles 97 respectively, such that the sleeves 51, 61 move in concert with the respective slides 96 and such that the sleeves 51, 61 may be moved or adjusted along the respective bars 2, 3 by the motors 91. A pair of links 5, 6 each includes one end pivotally or rotatably secured to the free ends of the cranks 14, 15 at the axles 16, 17 respectively, and each includes the other end pivotally or rotatably secured to the respective sleeves 51, 61 with the pivot poles 97 or with the other pivots, such that the other ends of the links 5, 6 may be moved or adjusted along the respective bars 2, 3 together with the respective sleeves 51, 61, by the motors 91. The foot supports 72, 82 thus may also be adjusted relative to the bars 2, 3 in order to adjust the moving stride of the foot supports 72, 82, when the sleeves 51, 61 of the links 5, 6 are adjusted relative to the bars 2, 3.

A switch 18 is disposed on one of the bars 2, 3, such as disposed on top of the handle 32 of the bar 3. The switch 18 is coupled to the motor 91 and/or to the control box 10 for operating the motor 10 to adjust the the sleeves 51, 61 of the links 5, 6, and thus the foot supports 72, 82 relative to the bars 2, 3. For example, when the switch 18 is depressed once, the sleeves 51, 61 may be moved upward along the bars 2, 3 respectively, by the motor 91. The sleeves 51, 61 may be moved downward along the bars 2, 3 respectively when the switch 18 is depressed twice, and may not be moved relative to the bars 2, 3 when the switch 18 is depressed three times. One or more further switches 19 may further be provided and disposed on the bars 2, 3, such as disposed on the other bar 2 (FIGS. 1, 2) for adjusting the resistive force against the movement of the foot supports 72, 82, for example.

Figure 5:
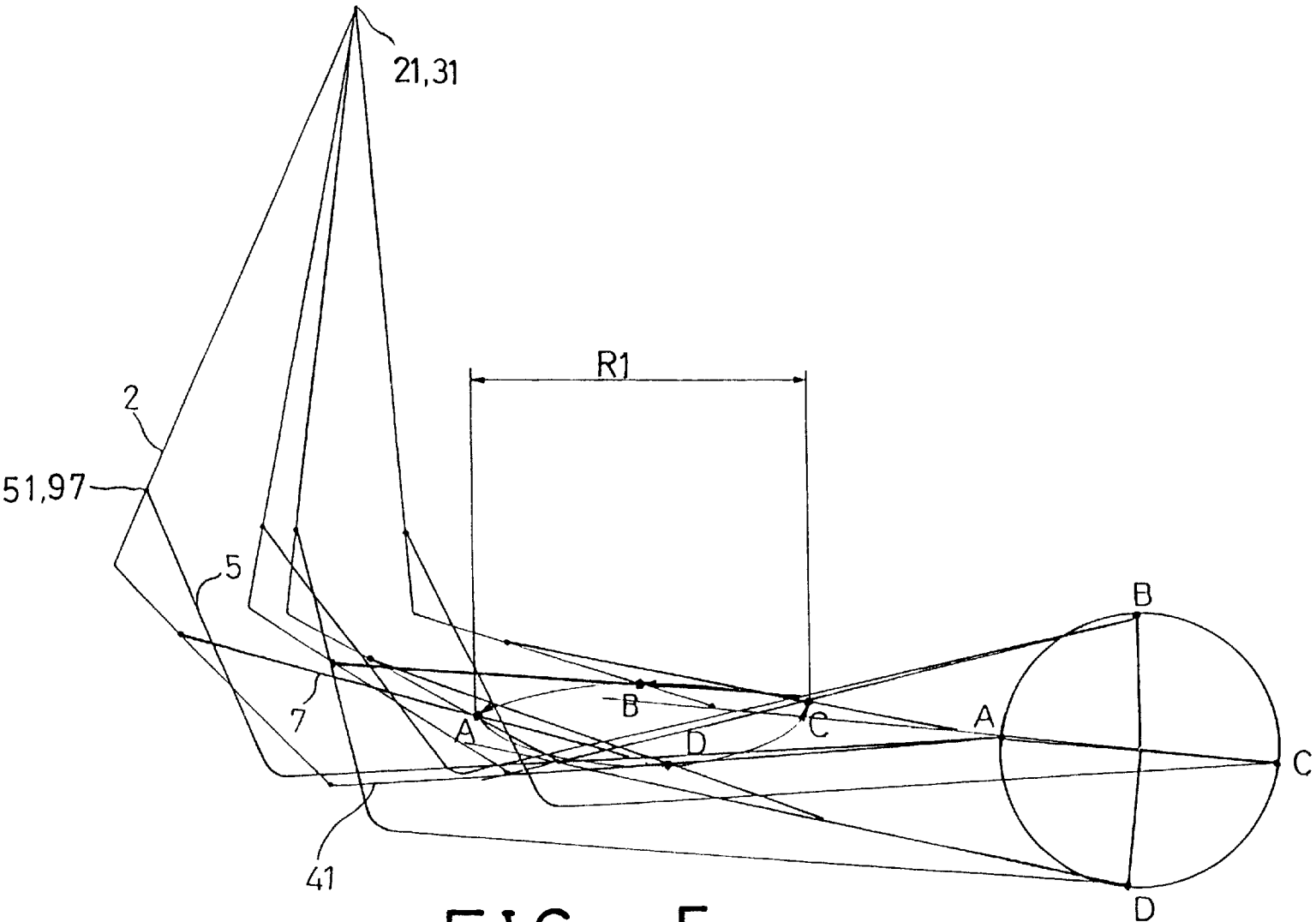
FIGS. 5 and 6 are schematic views illustrating the operation of the exerciser.
Figure 6:
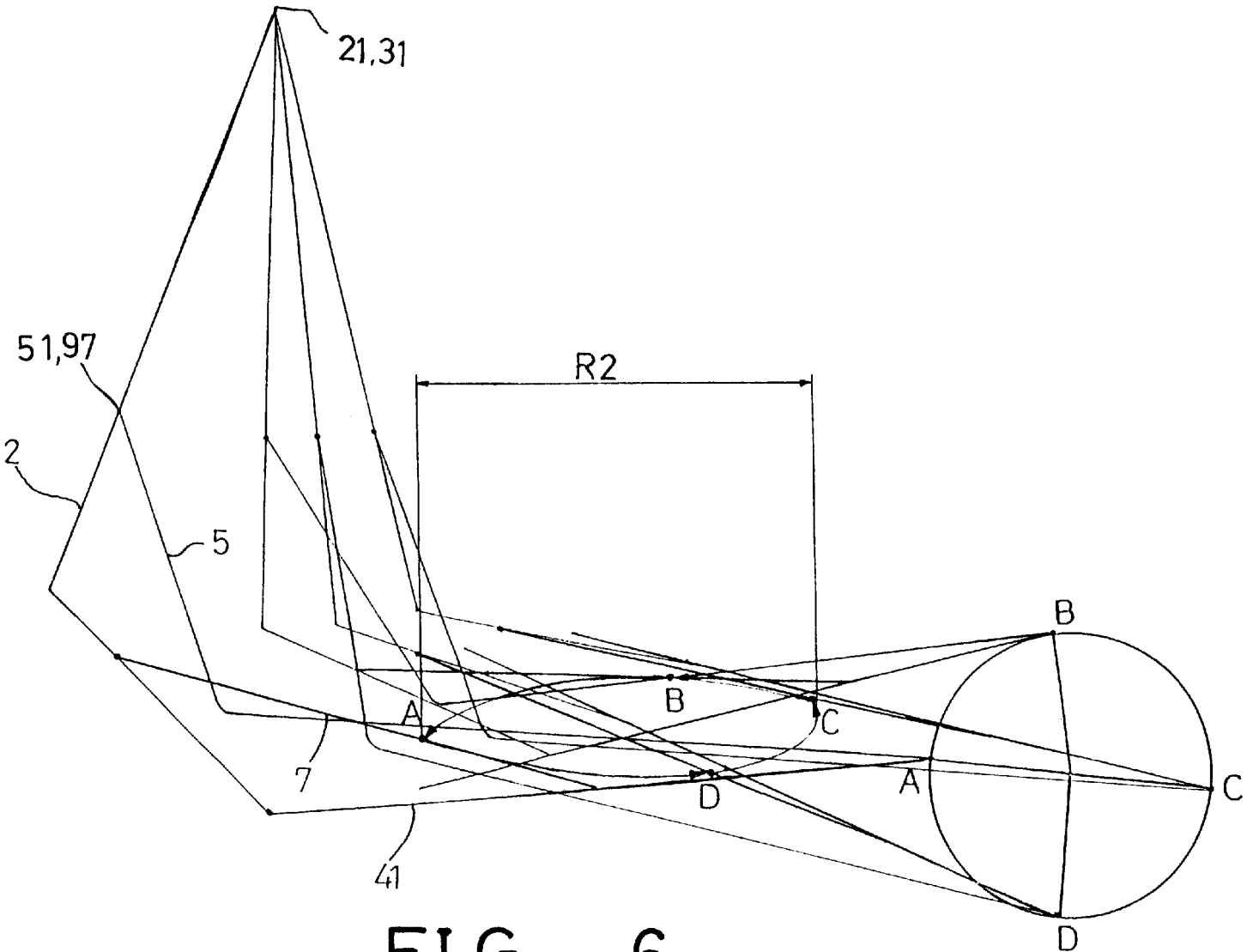

In operation, as shown in FIGS. 1, 2, 5, and 6, the foot supports 72, 82 may be moved along an elliptical moving path or an elliptical stride when the bars 2, 3 are moved or rotated about the rods 21, 31 and when the cranks 14, 15 are rotated about the pivot shaft 131. The other ends of the links 5, 6 may be moved or adjusted along the respective bars 2, 3 by the motors 91 via the pinions 92, the reduction gearing mechanisms 93, the gears 95, the bolts 90, the tubes 94, the slides 96 and the sleeves 51, 61, such that the elliptical moving path or the strides of the foot supports 72, 82 may be adjusted. For example, as shown in FIGS. 5 and 6, the sleeves 51, 61 may be moved or adjusted away from (FIG. 5) or closer to (FIG. 6) the rods 21, 31, the longitudinal axis R1, R2 of the elliptical moving paths may thus be adjusted according to the users' requirements. The wheel 13 may provide a resistive force against the movement of the foot supports 72, 82.

It is to be noted that the motor 91 may still be actuated to adjust the the sleeves 51, 61 of the links 5, 6, and thus the foot supports 72, 82 relative to the bars 2, 3 while the bars 2, 3 are operated or are swung by the users, or while the exerciser is still operated or actuated. The switches 18, 19 may be operated or actuated by the hands of the users that hold the handles 22, 32 without stopping the exercisers.

Accordingly, the stepping exerciser in accordance with the present invention includes an adjustable mechanism for easily and quickly adjusting the moving stroke or the moving path or the stride of the exerciser without stopping the exerciser, or while the exerciser is still operated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a front portion, a pair of bars Pivotally secured to said front portion of said base and each including an upper portion for being grasped by hands of users, a pair of levers movably supported on said base and each including a foot support provided thereon, means for coupling said bars to said levers and to move said levers and said foot supports in a reciprocating action, means for adjusting said levers relative to said bars in order to adjust said foot supports relative to said bars, and a switch provided on said upper portion of a first of said bars for actuating said adjusting means with the hand of the user that holds said upper portion of said first bar.

2. The exerciser according to claim 1, wherein said base includes a post extended from said front portion of said base and having an upper portion, said base includes a rear portion having a pair of cranks rotatably secured thereto with a pivot shaft, said cranks each includes a free end, said bars are pivotally secured to said upper portion of said post and each includes a bottom portion, said coupling means includes a pair of tracks having a first end rotatably secured to said free ends of said cranks respectively and having a second end portion movably supported on said bottom portion of said bars, and includes a pair of links each having a first end rotatably secured to said free ends of said cranks respectively and each having a second end slidably secured to said bottom portions of said bars respectively, said levers each includes a first end pivotally secured to said bars respectively with a pivot pin, and each includes a second end slidably engaged on said tracks respectively.

3. The exerciser according to claim 1, wherein said bars each includes a slide slidably received therein, said coupling means is provided for coupling said slides of said bars to said levers respectively.

4. The exerciser according to claim 3, wherein said adjusting means is provided for adjusting said slides relative to said bars respectively to adjust a stride of said foot supports.

5. An exerciser comprising:

a base including a front portion, a pair of bars pivotally secured to said front portion of said base and each including an upper portion for being grasped by hands of users, said bars each including a slide slidably received therein, a pair of levers movably supported on said base and each including a foot support provided thereon, means for coupling said slides of said bars to said levers and to move said levers and said foot supports in a reciprocating action, a motor, means for connecting said motor to said slides to move said slides relative to said bars respectively, and to adjust said levers relative to said bars and to adjust said foot supports relative to said bars and to adjust a stride of said foot supports, and a switch provided on said upper portion of a first of said bars for actuating said motor with the hand of the user that holds said upper portion of said first bar.

6. The exerciser according to claim 5, wherein said bars each includes a chamber formed therein for slidably receiving said slides respectively, said connecting means includes a pair of bolts rotatably received in said bars respectively and threadedly coupled to said slides respectively, and said motor is coupled to said bolts for rotating said bolts to move and to adjust said slided along said bars respectively.

7. The exerciser according to claim 6, wherein said slides each includes a tube coupled thereto and threadedly engaged with said bolts respectively, said connecting means includes a pinion attached to each of said motors, a gear attached to each of said bolts and coupled to said pinions respectively for coupling said motors to said bolts respectively.

8. An exerciser comprising:

a base including a front portion, a pair of bars pivotally secured to said front portion of said base and each including an upper portion for being grasped by hands of users, said bars each including a sleeve slidably engaged thereon, a pair of foot supports movably supported on said base, means for coupling said sleeves of said bars to said foot supports and to move said foot supports in a reciprocating action, a motor, means for connecting said motor to said sleeves and to adjust said sleeves along said bars and to adjust said foot supports relative to said bars, and a switch provided on said upper portion of a first of said bars for actuating said motor with the hand of the user that holds said upper portion of said first bar.

* * * * *